US008387601B1

(12) United States Patent
Christensen

(10) Patent No.: US 8,387,601 B1
(45) Date of Patent: Mar. 5, 2013

(54) DISK LAUNCHING APPARATUS AND METHOD

(76) Inventor: Thomas E. Christensen, Gardnerville, NV (US)

( * ) Notice: Subject to any disclaimer, the term of this patent is extended or adjusted under 35 U.S.C. 154(b) by 626 days.

(21) Appl. No.: 12/586,521

(22) Filed: Sep. 23, 2009

(51) Int. Cl.
*F41J 9/16* (2006.01)
*F41J 9/18* (2006.01)

(52) U.S. Cl. ..... 124/5

(58) Field of Classification Search ..... 473/505; 124/4–6, 17, 18; D22/114; D21/301, 454, D21/722
See application file for complete search history.

(56) References Cited

U.S. PATENT DOCUMENTS 3,428,036 A * 2/1969 Parker ..... 124/5
4,661,113 A * 4/1987 Adkins ..... 623/65
D346,183 S * 4/1994 Crane ..... D21/443
7,665,454 B1 * 2/2010 D'Agostino ..... 124/5

* cited by examiner

*Primary Examiner* — Gene Kim
*Assistant Examiner* — Amir Klayman
(74) *Attorney, Agent, or Firm* — John W. Crosby

(57) ABSTRACT

A disk launching apparatus that employs a handle connected to a flexible shaft that is connected to a launching head. The head includes a first arcuate portion and a second arcuate portion arranged in a semi-circular configuration to define a space in which a disk is retained in contact with the first and second arcuate members. At least one securing point is located on the first arcuate member and a plurality of securing points located on the second arcuate member. An elastic band is attached between the first securing point on the first arcuate member and one of the plurality of securing points located on the second arcuate member, thereby crossing a disk held within the launching head.

25 Claims, 8 Drawing Sheets

FIG. 5
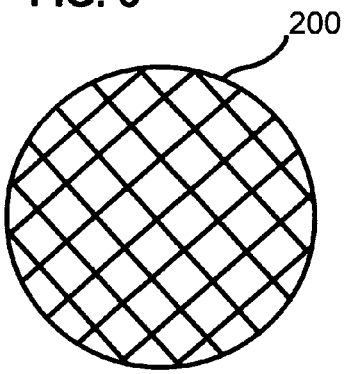
FIG. 6
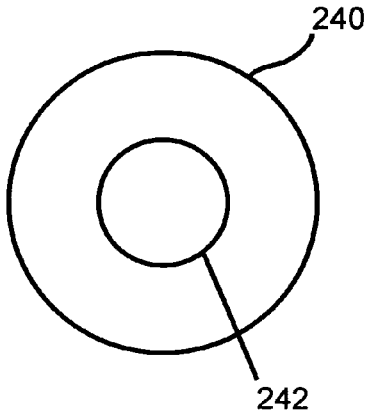
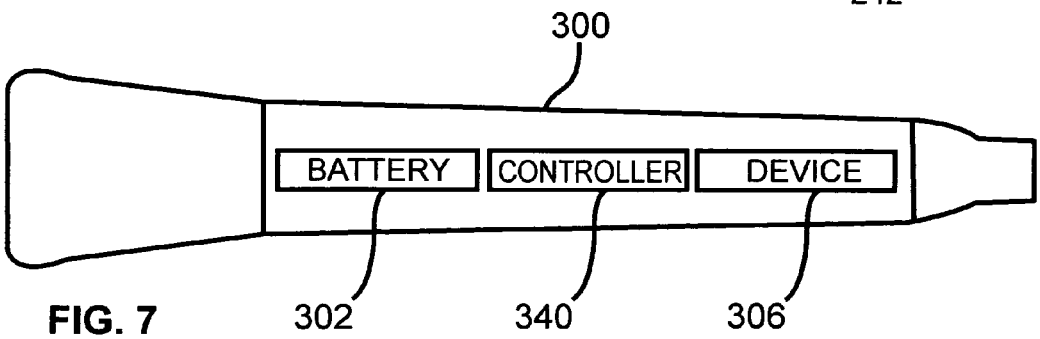
FIG. 7
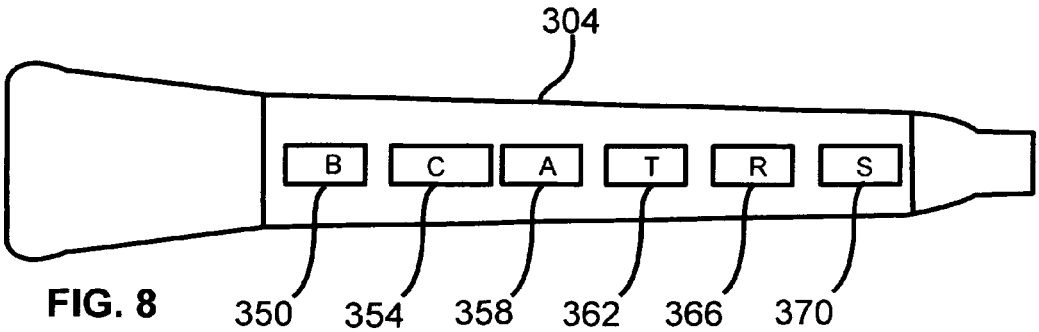
FIG. 8

DISK LAUNCHING APPARATUS AND METHOD

FIELD OF THE INVENTION

The present invention relates generally to an apparatus for launching flying disks. Specifically, the present invention relates to an apparatus for launching flying disks that maintains contact around a substantial portion of the circumferential edge of a flying disk, and allows a user to exert force by swinging the apparatus with two hands in a manner similar to swinging a baseball bat or a golf club.

BACKGROUND OF THE INVENTION

Flying disks have been enjoyed by the sporting public for more than 50 years. Generally thrown by hand, these flying disks, such as Frisbee™ products by Wham-o, Inc., are usually flat, lightweight disks with a circumferential edge that rotate while flying. Aside from simple games of catch, where the disk is tossed between two players, flying disks have also found application in rule-based games, such as disk golf, or disk baseball, where the disk replaces the traditional ball used in the respective games. The basic flying disk has evolved from the lightweight Frisbee™ disk to better suit these games, offering smaller diameter and heavier designs that are thrown farther and with desired handling and flying characteristics.

However, players are still limited in the distance that a human arm can throw a flying disk. Depending on disk design and wind conditions, a distance of 300 feet is generally considered to be at the far end of human ability to throw a flying disk.

While the above discussion has focused on flying disks thrown by hand, prior art lacks focus on the question of increasing force, velocity and spin rate to the launching of a flying disk. Some art focuses on providing a hand-held apparatus for launching a flying disk, for instance in the area of clay pigeons used in skeet shooting applications.

U.S. Pat. No. 4,076,004 to Huelskamp shows such a launcher for clay pigeons. As illustrated and described, this is a one-handed launching apparatus that does not contemplate distances longer than a human arm can throw a flying disk. Even if Huelskamp is used with two hands holding its grip, its overall length limits the amount of force with which the launcher can be swung.

U.S. Pat. No. 4,157,828 to Cosmopulos shows a disc launching and catching device. Cosmopulos' design incorporates a handle attached to an elongated curved head. However, even if two hands are placed in crossbar 56 as one would a baseball bat or golf club, there is not enough distance from crossbar 56 to a disk that would allow generation of sufficient force to launch a flying disk beyond distances capable by a human arm using no device. Furthermore, there is not enough contact along the circumference of a disk to provide friction necessary to generate sufficient spin to throw a disk beyond the human arm's capability.

U.S. Pat. No. 5,181,500 to Chamberland shows a pair of pincers for throwing and catching a flying disc, which also suffers similar shortcomings. Chamberlain's design fails to provide a large enough contact area to generate spin. Chamberlain actually works less effectively as the human hand because of this reduced contact area.

Finally, US Patent Application Pub. No. 2005/0070198 to Pickering incorporates a neck between a handle and a disk launching head. However, Pickering discloses a hinged head and a collapsible neck. The hinged head does not maintain a disk in contact with the entire gripping area of the launcher; rather, upper portion 16 is forced back when the user throws a flying disc that is held by the C shape 150. Because hinged joint 10 connects two separate pieces, there is insufficient flexion in handle portion 50 to help deliver force to C shape 150.

The prior art discussed above also share an additional shortcoming. None address the problem of locating a lost disk. A problem inherent with long distance throws of a flying disk is losing the disk in the brush.

The prior art discussed above share yet another shortcoming. None address the issue of fitting an amputee with a disk launching apparatus.

SUMMARY OF THE INVENTION

It is an objective of the present invention to provide a disk launching apparatus farther and with less effort that previously seen in the prior art.

It is an objective of the present invention to provide a disk launching apparatus that utilizes a flexible shaft to provide a whip motion that imparts additional power to a launched disk.

It is an objective of the present invention to provide a disk launching apparatus that utilizes a variety of elastic bands for improved grip and compression on a disk to provide increased spin and velocity to a launched disk.

It is an objective of the present invention to provide a disk launching apparatus that utilizes a variety of shafts having different lengths and degrees of flexibility as well as varying diameters of club heads.

It is an objective of the present invention to provide a disk launching apparatus that allows a user to swing the apparatus with both arms, thereby imparting additional power to a launched disk.

It is an objective of the present invention to provide a disk launching apparatus that incorporates a catching device for catching flying disks.

It is an objective of the present invention to be attached to the remaining portion of an amputee's limb.

It is an objective of the present invention to impart a flavoring agent to a thrown disk to attract a dog to a thrown disk.

It is an objective of the present invention to provide a disk launching apparatus that communicates with a launched disk to aid in recovery of lost disks.

The present invention solves the problems described above by providing a disk launching apparatus that employs a handle connected to a flexible shaft that is connected to a launching head. The head includes a first arcuate portion and a second arcuate portion arranged in a semi-circular configuration to define a space in which a disk is retained in contact with the first and second arcuate members. At least one securing point is located on the first arcuate member and a plurality of securing points located on the second arcuate member. An elastic band is attached between the first securing point on the first arcuate member and one of the plurality of securing points located on the second arcuate member, thereby crossing a disk held within the launching head. The disk is thrown by a user holding the handle with two hands, and swinging the apparatus in a motion similar to a golf club swing or a baseball bat swing, thus releasing the disk by centrifugal force at a desired point on the swing. The power imparted by the user during the swing is sufficient to generate enough spin to propel the disk a distance of 500 feet or more.

With greater distance throws comes an increased incidence of lost disks. In an embodiment, the present invention incorporates a communication system between a disk and the disk launching apparatus. By incorporating a communication device in the disk launching device and another communication device in the disk launching apparatus, a user can locate lost disks by bringing the disk launching apparatus to an area where the thrown disk may have landed, and waiting for an indication from the communication device on the disk launching apparatus that a signal from a disk has been received. In an embodiment, a radio frequency identification (RFID) tag is located in the disk, and the disk launching apparatus sends a signal repeatedly until the RFID tag is read, for example, from a distance of approximately 25 to 30 feet or more. In another embodiment, a signal can be periodically emitted from a thrown disk, and when the signal is received in sufficient strength by the communication device on the disk launching apparatus, an indication of a located disk is conveyed to a user.

In an embodiment, a flashlight is located in the handle of the disk launching apparatus to aid in searching for lost disks where lighting is poor, or for illuminating to indicate the proximity of a lost disk.

In another embodiment, an audible alarm is located in the handle of the disk launching apparatus, and activated to indicate the proximity of a lost disk.

Additional features and advantages of the present invention will become apparent to one skilled in the art of the present invention upon reading the following detailed description of the invention, when considered in conjunction with the accompanying figures, in which:

BRIEF DESCRIPTION OF THE DRAWINGS

FIG. 5 illustrates a speaker mounted inside the handle of the disk launching apparatus of the present invention.

FIG. 6 illustrates a light mounted inside the handle of the disk launching apparatus of the present invention.

FIG. 7 illustrates in functional block diagram form major functional components contained within the handle of the disk launching apparatus of the present invention.

FIG. 8 illustrates in functional block diagram form more detailed functional components of a communication system contained within the handle of the disk launching apparatus of the present invention.

DETAILED DESCRIPTION OF THE INVENTION

Figure 1A:
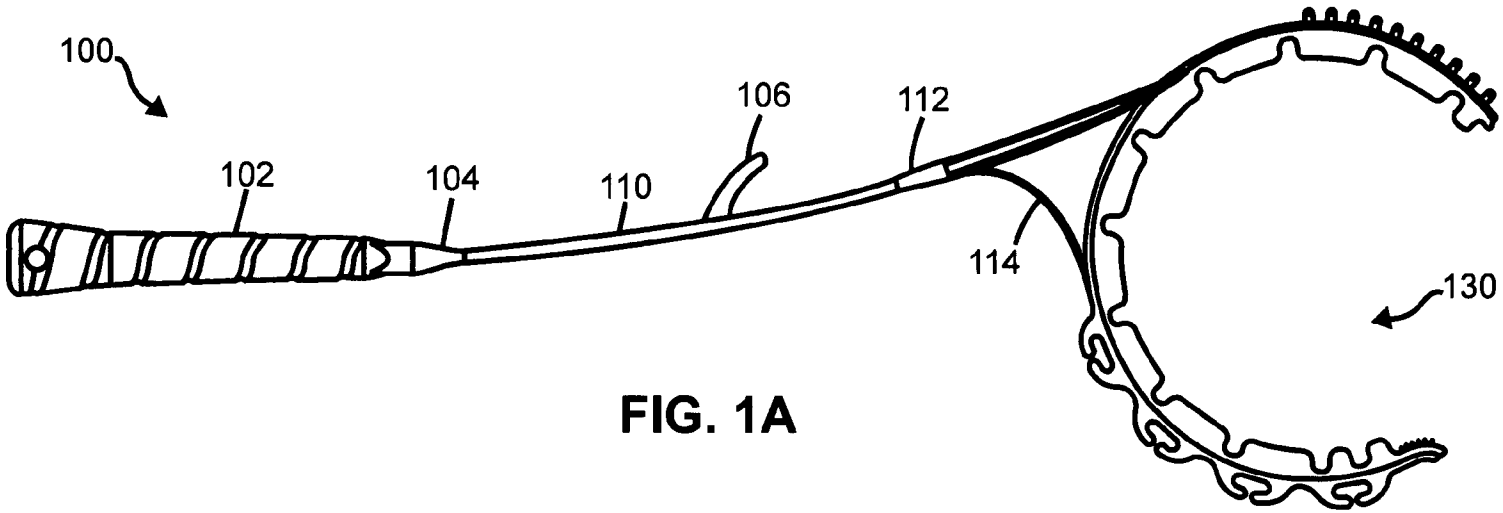
FIG. 1A is a plan view of the present invention.

Directing attention to FIGS. 1A through 1D, there is shown generally a disk CLUB launching apparatus 100 that incorporates handle 102, shaft interface 104 that connects handle 102 to flexible shaft 110, catching retainer 106 proximate to handle 102 and shaft interface 104, and shaft interface 112 that connects shaft 110 with launching head brace 114. Aperture 103 can also be included to aid attachment of an amputee interface or locating electronics described herein.

Figure 1B:
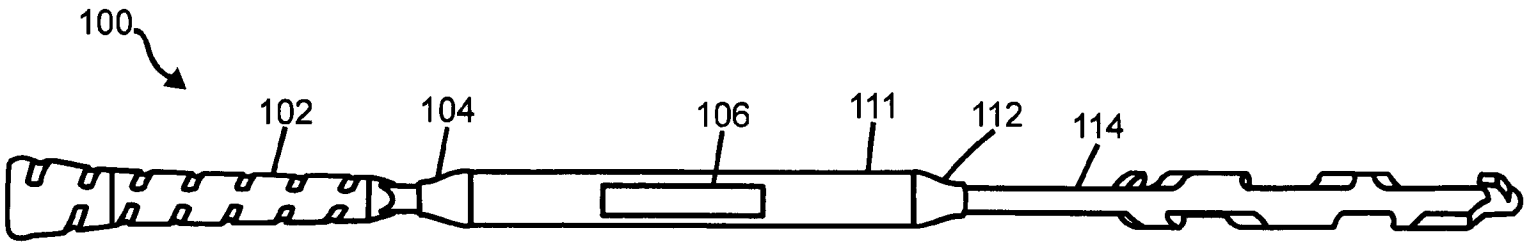
FIG. 1B is an elevation view of the present invention.
Figure 1C:
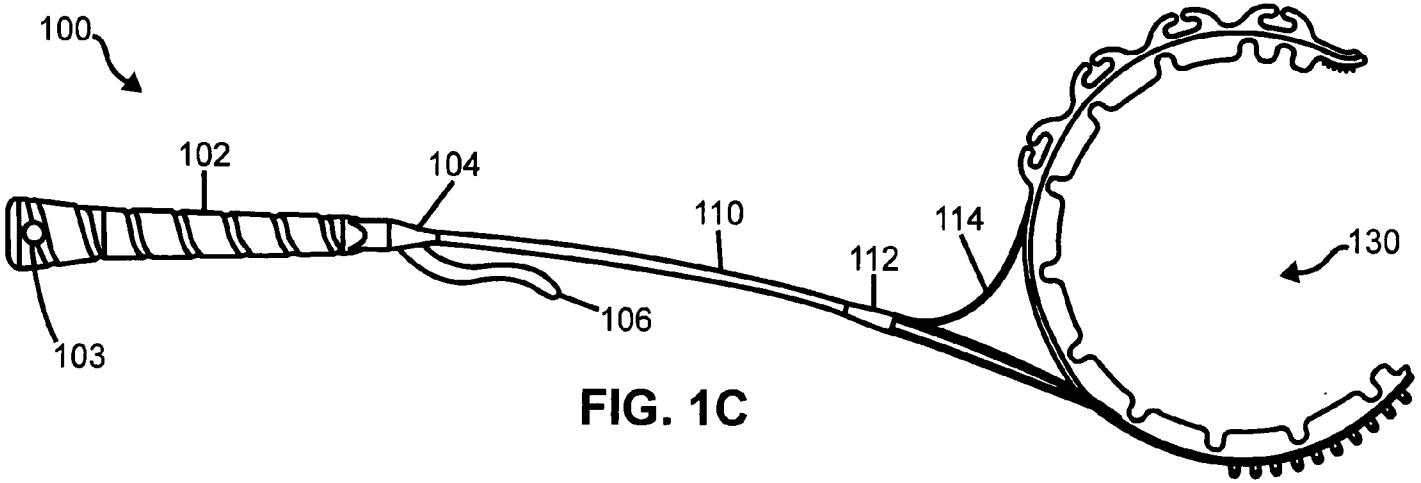
FIG. 1C is a plan view of the opposite side of the present invention shown in FIG. 1A.
Figure 1D:
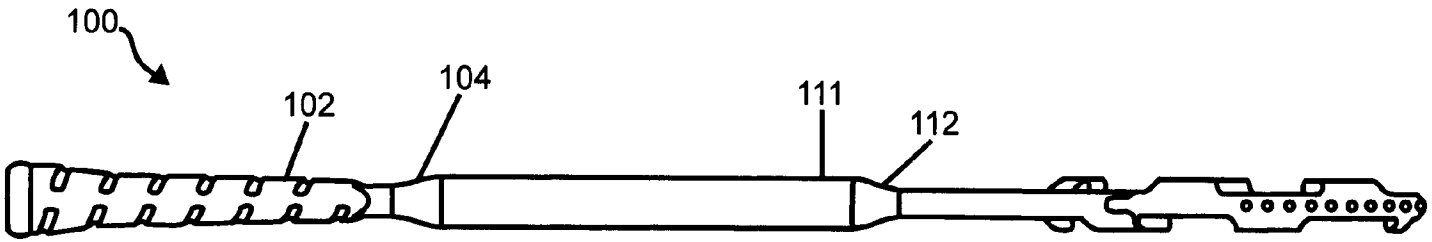
FIG. 1D is an elevation view of the opposite side of the present invention shown in FIG. 1C.

As shown in FIGS. 1B and 1D, in an embodiment, shaft 110 has a wide flange 111 in one dimension to provide additional strength to shaft 110. In an embodiment, shaft 110 is removable from launching head brace 114 to provide interchangeability with a variety of shafts of different lengths and degrees of flexibility. This is particularly useful for using disk launching apparatus 100 for different distance throws, for example, as desired in a game of disk golf or disk baseball or other disk-launching applications.

In an embodiment, catching retainer 106 is incorporated on the back side of disk launching apparatus 100 near the forward end of handle 102. By holding disk launching apparatus in a substantially vertical orientation, tipped toward an incoming flying disk, disk launching apparatus 100 can be used as a catching device while providing a degree of protection to a user by placing shaft 110 in a vertical orientation between the incoming disk and the user.

Figure 2:
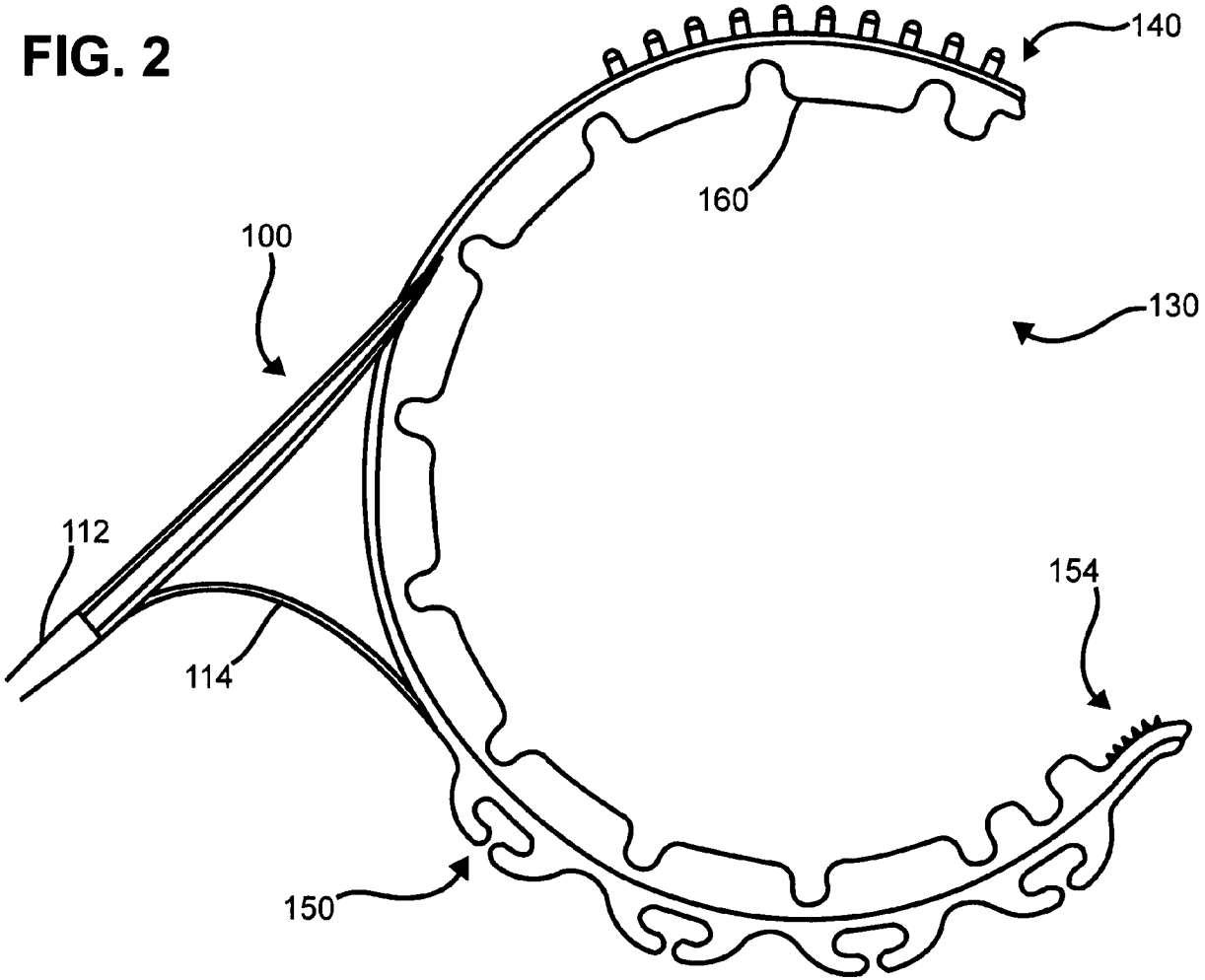
FIG. 2 is a plan view of the launching head of the present invention.
Figures 11, 12:
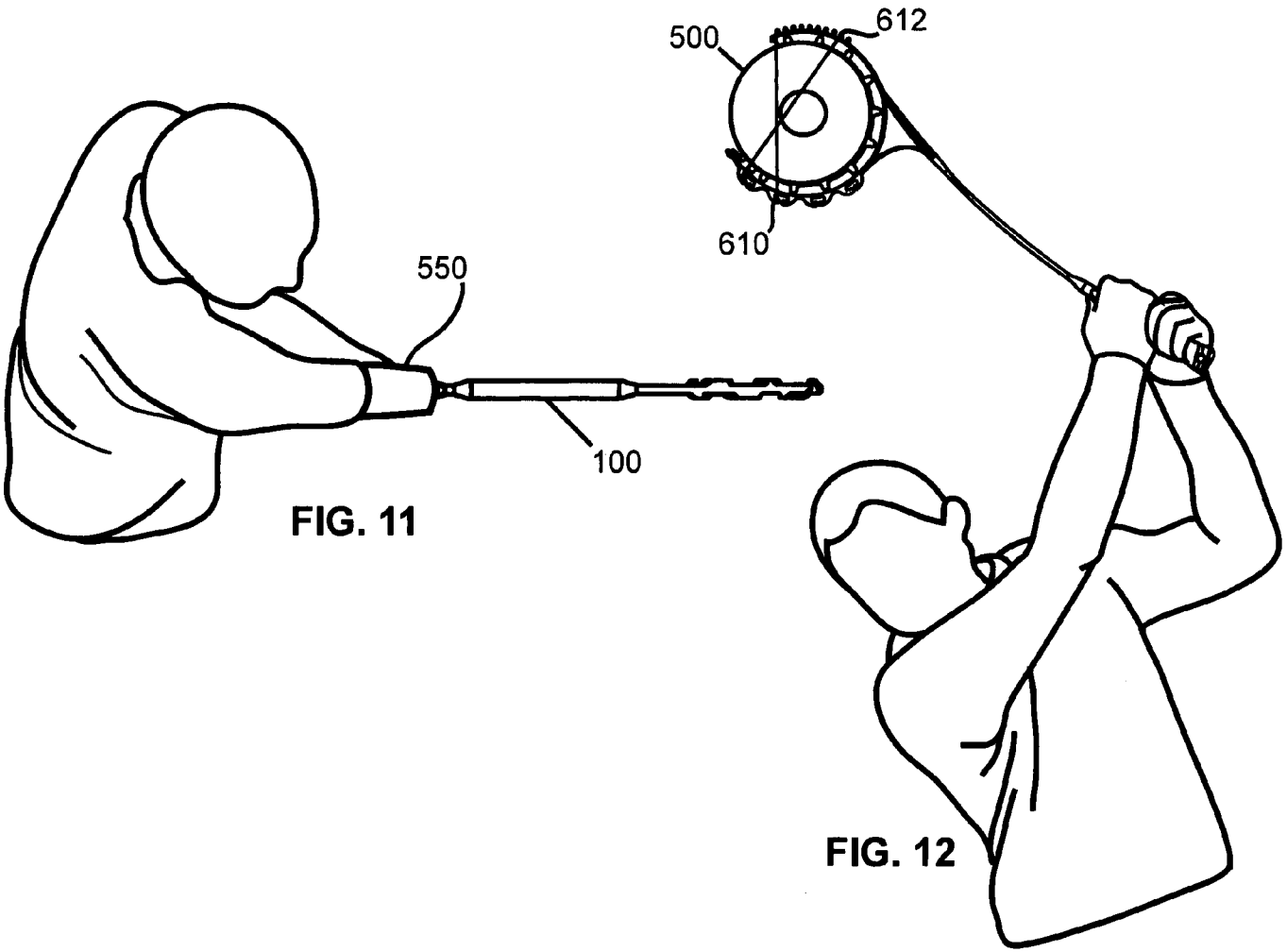
FIG. 11 illustrates an interface between the disk launching apparatus of the present invention and an amputee user.
FIG. 12 illustrates the disk launching apparatus with a disk secured within the launching head with elastic bands.

Directing attention to FIG. 2, disk launching head 130 incorporates a semicircular surface for gripping a disk. A first arcuate portion has a plurality of attachment tabs 140 located on the outer circumference of disk launching head 130. A second arcuate portion has a plurality of band securing tabs 150 on the outer circumference of disk launching head 130, approximately 180 degrees from the plurality of attachment tabs 140. Additional spin can be generated in a launched disk by incorporated gripping surfaces 154 in an of disk launching head 130 near band securing tabs 150. Launching head 130 is secured around a disk by placing a disk between receiving tabs 160 in disk launching head 130, and stretching at least one elastic band between ones of attachment tabs 140 and securing tabs 150, thereby drawing the two arcuate portions of disk launching head 130 toward each other around an inserted disk, as shown in FIG. 12, where elastic bands 610 and 612 are stretched across disk 500 on both sides of disk 500. It is contemplated that elastic bands having different moduli of elasticity are used for different types of launches. For example, longer distance launches require tighter elastic bands than shorter distance launches. The modulus of elasticity of a given elastic band is chosen based on user preference and application of disk launching apparatus 100.

For users of disk launching apparatus 100 that are launching disks to exercise a dog in a game of fetch, a flavoring agent can be placed along the inside of disk head 130, so that it is brought in contact with disk circumferential surface 502 (FIG. 9), so that the flavor serves as a reward for a dog that retrieves a thrown disk. In an alternative embodiment, flavor can be integral to the disk itself.

Figure 3:
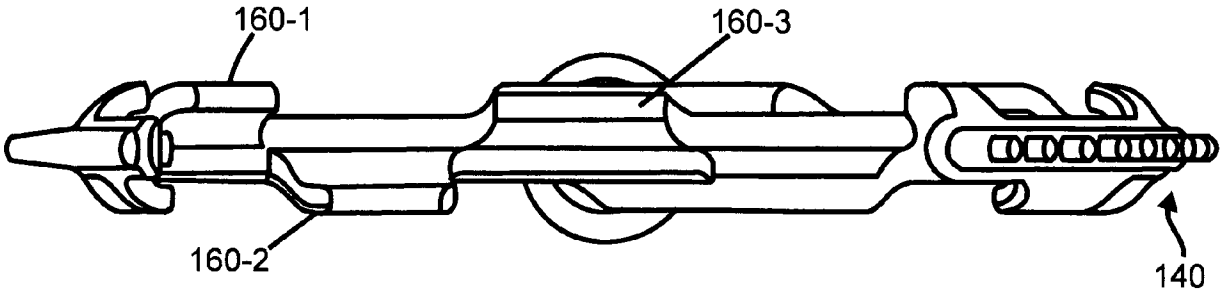
FIG. 3 is an elevation view of the present invention as viewed from the launching head end of the disk launching apparatus of the present invention.

Directing attention to FIG. 3, receiving tabs 160 are shown arranged in a staggered relationship with respect to each other, so that receiving tabs 160-1 and 160-3 are on one side of an inserted disk, and 160-2 is on the opposite side of an inserted disk, at a location along the circumference of the inserted disk that is between receiving tabs 160-1 and 160-3.

Figure 4:
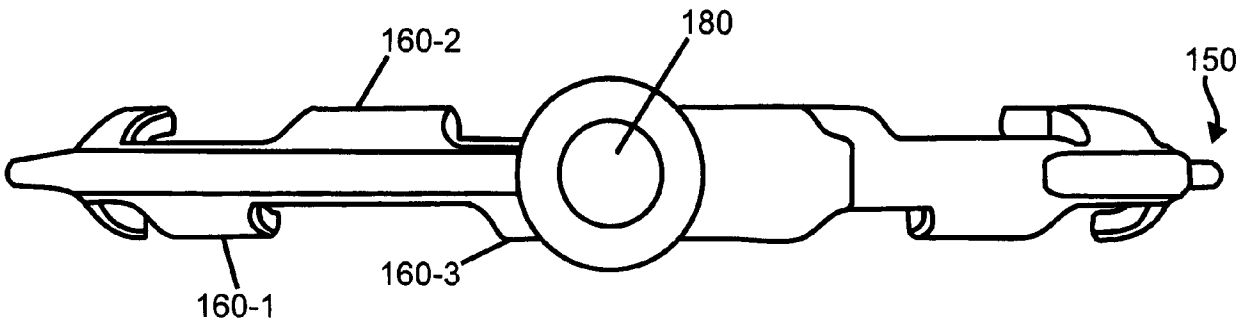
FIG. 4 is an elevation view of the present invention as viewed from the handle end of the disk launching apparatus.

Directing attention to FIG. 4, in an embodiment, handle 102 includes a hollow portion 180 that can be used for various devices used for locating a lost disk. It is contemplated that communication between a lost disk and disk launching apparatus 100 can be established to locate a lost disk. Detection of a lost disk can be effected by speaker 200 (FIG. 5) activated when disk launching apparatus 100 is near the lost disk. Lamp 240, having bulb 242, can also be activated to indicate that disk launching apparatus 100 is near a lost disk, or can be operated manually in conditions where lighting is poor. In an embodiment, lamp 240 activates disks constructed of glow in the dark materials.

Directing attention to FIG. 7, handle 300 can be used in place of handle 200, and incorporates in its most basic functional forms battery 302, which is used by controller 304 and device 306.

Figure 9:
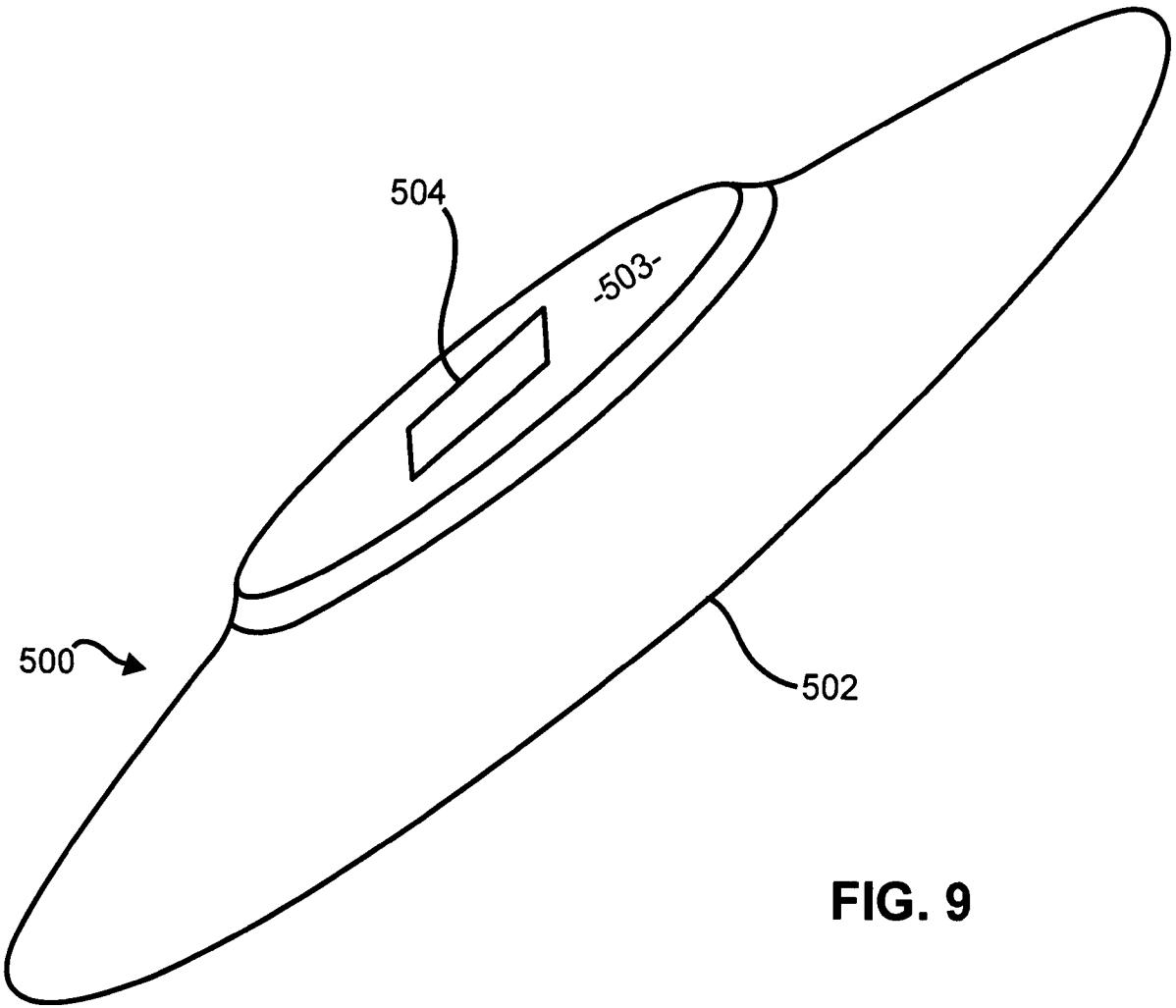
FIG. 9 illustrates a disk having a communication device used in conjunction with the disk launching apparatus of the present invention.

As shown in FIG. 8, handle 340 can also be used in place of handle 200, and incorporate battery 350, controller 354, antenna 358, transmitter 362, receiver 366, and speaker 370. Transmitter 362 communicates with communication device 504, located on central surface 503 of disk 500 (FIG. 9). In an embodiment, communication device 504 is a simple RFID tag that reflects an identifier when illuminated by an RF signal emitted by transmitter 362. The identifier signal emitted from the illuminated RFID tag is then detected by antenna 358, passed to receiver 366, which in turn relays the detection to controller 354, which activates speaker 370 or another signal means to convey to the user that a lost disk is nearby. This embodiment is useful for locating lost disks from distances up to approximately 25-30 feet or more. Other location mechanisms such as global positioning satellite (GPS) can be used.

Figure 10:
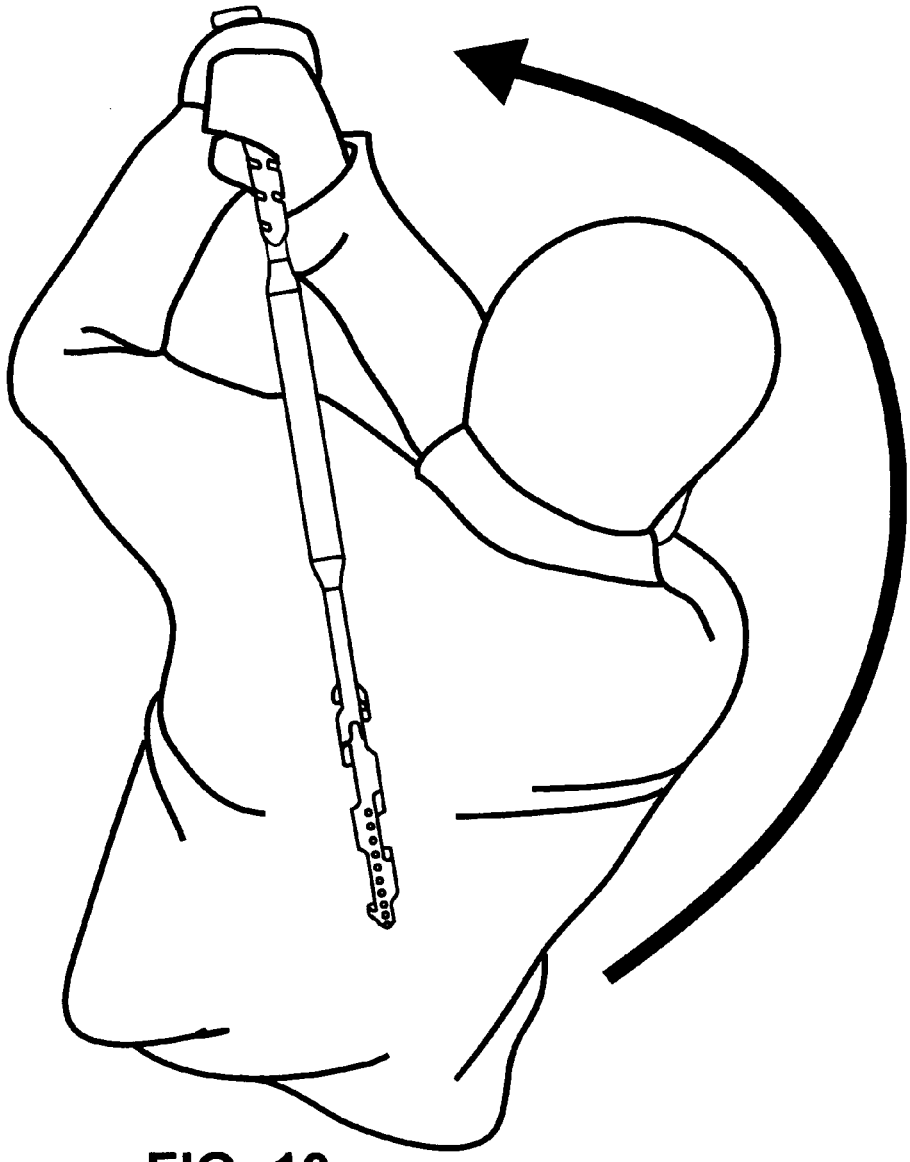
FIG. 10 illustrates the motion of a swing contemplated for use with the disk launching apparatus of the present invention.

Disk launching apparatus 100 is generally used in a swinging motion similar to the motion used to swing a golf club or a baseball bat. While other swinging motions can be used, for example for shorter distances, the swing shown in FIG. 10 generates sufficient energy to launch a flying disk from disk launching apparatus 100 to distances of 500 feet or more.

An amputee interface 550 can be incorporated into handle 102 to fit disk launching apparatus 100 to the limb of an amputee. For two-handed power swings, an amputee user can grasp the portion of handle 102 that is near interface 550 with one hand, thereby implementing a two-armed swing. Ith practice, an amputee can throw a disk with a single arm swing.

While a disk launching apparatus and method have been described and illustrated in detail herein in their best modes, numerous modifications can be made to the various embodiments of the present invention without departing from the spirit thereof.

What is claimed is:

1. A disc-launching apparatus, comprising:

a head, the head consisting of a first arcuate member and a second arcuate member, the first and second arcuate members arranged in a semi-circular configuration to define a space in which a disc is retained in contact with the first and second arcuate members;

a first securing point located on the first arcuate member;

a plurality of securing points located on the second arcuate member;

an elastic band attached between the first securing point on the first arcuate member and one of the plurality of securing points located on the second arcuate member;

a flexible handle attached to the head; and a plurality of raised contours arranged on at least one surface of the first arcuate member and the second arcuate member, the raised contours consisting of protrusions are brought into contact with the edge of a disk placed within the defined space between the first and second arcuate members, the protrusions arranged to contact the edge of the disk in a perpendicular arrangement with respect to a circumferential edge of the disk.

2. The disk-launching apparatus of claim 1, wherein the head and flexible handle are detachable.

3. The disk-launching apparatus of claim 1, wherein a flavor agent is placed on interior edges of at least one of the group consisting of the first arcuate member and the second arcuate member.

4. The disk-launching apparatus of claim 1, wherein the handle comprises a locating device, the locating device configured to transmit a signal to a receiver mounted on a disk.

5. The disk-launching apparatus of claim 1, wherein the handle comprises a locating device, the locating device configured to receive a signal from a disk and indicate to a user the proximity of a disk.

6. The disk-launching apparatus of claim 1, wherein the handle comprises a light mounted at an end of the handle.

7. The disk-launching apparatus of claim 1, wherein the handle comprises at least one receiving member, the receiving member protruding radially from the handle angled to receive a flying disk during flight.

8. The disk-launching apparatus of claim 1, wherein said disk-launching apparatus is part of a kit, the kit including a plurality of disks having locating devices, the kit also including a plurality of elastic bands having different degrees of elasticity.

9. A disc-launching apparatus, comprising:

a head, the head consisting of a first arcuate member and a second arcuate member, the first and second arcuate members arranged in a semi-circular configuration to define a space in which a disc is retained in contact with the first and second arcuate members;

a first plurality of securing points located on the first arcuate member;

a second plurality of securing points located on the second arcuate member;

an elastic band attached between one of first plurality of securing points on the first arcuate member and one of the second plurality of securing points located on the second arcuate member;

a handle attached to the head, the handle configured to accommodate two hands gripping the handle simultaneously in a contiguous relationship with respect to each other; and a plurality of raised contours arranged on at least one surface of the first arcuate member and the second arcuate member, the raised contours consisting of protrusions are brought into contact with the edge of a disk placed within the defined space between the first and second arcuate members, the protrusions arranged to contact the edge of the disk in a perpendicular arrangement with respect to a circumferential edge of the disk.

10. The disk-launching apparatus of claim 9, wherein the head and flexible handle are detachable.

11. The disk-launching apparatus of claim 9, wherein a flavor agent is placed on interior edges of at least one of the group consisting of the first arcuate member and the second arcuate member.

12. The disk-launching apparatus of claim 9, wherein the handle comprises a locating device, the locating device configured to transmit a signal to a receiver mounted on a disk.

13. The disk-launching apparatus of claim 9, wherein the handle comprises a locating device, the locating device configured to receive a signal from a disk and indicate to a user the proximity of a disk.

14. The disk-launching apparatus of claim 9, wherein the handle comprises a light mounted at an end of the handle.

15. The disk-launching apparatus of claim 9, wherein the handle comprises a receiving member, the receiving member protruding radially from the handle and angled to receive a disk during flight.

16. The disk-launching apparatus of claim 9, wherein said disk-launching apparatus is part of a kit, the kit including a plurality of disks having locating devices, the kit also including a plurality of elastic bands of different degrees of elasticity.

17. A disc-launching apparatus, comprising:

a head, the head consisting of a first arcuate member and a second arcuate member, the first and second arcuate members arranged in a semi-circular configuration to define a space in which a disc is retained in contact with the first and second arcuate members;

a first securing point located on the first arcuate member;

a second plurality of securing points located on the second arcuate member;

an elastic band attached between the first securing point on the first arcuate member and one of the plurality of securing points located on the second arcuate member;

a flexible handle attached to the head, the handle configured to accommodate two hands gripping the handle simultaneously in a contiguous relationship with respect to each other; and a plurality of raised contours arranged on at least one surface of the first arcuate member and the second arcuate member, the raised contours consisting of protrusions are brought into contact with the edge of a disk placed within the defined space between the first and second arcuate members, the protrusions arranged to contact the edge of the disk in a perpendicular arrangement with respect to a circumferential edge of the disk.

18. The disk-launching apparatus of claim 17, wherein the head and flexible handle are detachable.

19. The disk-launching apparatus of claim 17, wherein a flavor agent is placed on interior edges of at least one of the group consisting of the first arcuate member and the second arcuate member.

20. The disk-launching apparatus of claim 17, wherein the handle comprises a locating device, the locating device configured to transmit a signal to a receiver mounted on a disk.

21. The disk-launching apparatus of claim 17, wherein the handle comprises a locating device, the locating device configured to receive a signal from a disk and indicate to a user the proximity of a disk.

22. The disk-launching apparatus of claim 17, wherein the handle comprises a light mounted at an end of the handle.

23. The disk-launching apparatus of claim 17, wherein the handle comprises a receiving member, the receiving members protruding radially from the handle and angled to receive a disk during flight.

24. The disk-launching apparatus of claim 17, wherein said disk-launching apparatus is part of a kit, the kit including a plurality of disks having locating devices, the kit also including a plurality of elastic bands of different degrees of elasticity.

25. The disk-launching apparatus of claim 17, further comprising an amputee interface incorporated into the handle, the amputee interface securing the disk launching apparatus to the end of an amputated limb on a user.

* * * * *